US010529501B2

(12) United States Patent
Bunting

(10) Patent No.: US 10,529,501 B2
(45) Date of Patent: Jan. 7, 2020

(54) SWITCHING MECHANISM MOUNTABLE ON PRINTED CIRCUIT BOARD

(71) Applicant: KEZZA PRODUCTS PTY LIMITED, Emu Plains NSW (AU)

(72) Inventor: William Paul Bunting, Winmalee (AU)

(73) Assignee: Kezza Products Pty Limited, Emu Plains NWS (AU)

( * ) Notice: Subject to any disclaimer, the term of this patent is extended or adjusted under 35 U.S.C. 154(b) by 0 days.

(21) Appl. No.: 16/300,347

(22) PCT Filed: Feb. 5, 2018

(86) PCT No.: PCT/AU2018/000012
§ 371 (c)(1),
(2) Date: Nov. 9, 2018

(87) PCT Pub. No.: WO2018/141003
PCT Pub. Date: Aug. 9, 2018

(65) Prior Publication Data

US 2019/0348228 A1 Nov. 14, 2019

(30) Foreign Application Priority Data

Feb. 3, 2017 (AU) ..... 2017900337

(51) Int. Cl.
*H01H 1/16* (2006.01)
*H01H 9/30* (2006.01)
*H01H 19/11* (2006.01)

(52) U.S. Cl.
CPC ..... *H01H 1/16* (2013.01); *H01H 9/30* (2013.01); *H01H 19/11* (2013.01)

(58) Field of Classification Search
None
See application file for complete search history.

(56) References Cited

U.S. PATENT DOCUMENTS

| | | | | |
|---|---|---|---|---|
| 2,831,082 | A | 4/1958 | Mason | |
| 3,300,594 | A | 1/1967 | Paine | |
| 3,435,167 | A | 3/1969 | Pfleger | |
| 3,754,106 | A * | 8/1973 | MacDonald ..... | H01H 9/165 200/14 |

(Continued)

*Primary Examiner* — Truc T Nguyen
(74) *Attorney, Agent, or Firm* — Fox Rothschild LLP

(57) ABSTRACT

A switching mechanism for an electrical switch assembly has a rotary switch mounted on a printed circuit board. The rotary switch includes a contact block having a plurality of conductive contact faces arranged in the general shape of a polygon and adapted to roll from one contact face to another as the rotary switch is turned. There is a manually rotatable knob for turning the rotary switch. The knob is mounted on a surface spaced apart from the printed circuit board. A rotatable shaft assembly operatively connects the rotatable knob with the rotary switch so as to allow simultaneous and coordinated turning of the rotary switch when the knob is manually rotated. There is a plurality of conductive terminal contacts mounted on the printed circuit board and upon which the contact block rolls. Each conductive terminal contact is part of a circuit for a separate current flow pathway. Rolling of the contact block on its contact faces selectively opens a circuit and closes an adjacent circuit to allow electricity to flow along a desired current flow pathway.

7 Claims, 9 Drawing Sheets

(56) References Cited

U.S. PATENT DOCUMENTS

| | | | | |
|---|---|---|---|---|
| 4,599,501 | A * | 7/1986 | Migrin | B60R 16/005 200/260 |
| 5,049,709 | A | 9/1991 | Prickett et al. | |
| 5,519,370 | A * | 5/1996 | Perreira | H01H 3/001 218/123 |
| 6,087,607 | A * | 7/2000 | Dohnal | H01H 9/0033 200/11 TC |
| 2004/0075571 | A1* | 4/2004 | Fong | H01H 35/025 340/689 |
| 2010/0147664 | A1* | 6/2010 | Lin | H01H 19/06 200/336 |
| 2010/0147669 | A1* | 6/2010 | Lin | H01H 19/11 200/573 |
| 2014/0209441 | A1* | 7/2014 | Yang | H01H 19/11 200/179 |
| 2015/0146337 | A1* | 5/2015 | Connell | H01H 50/44 361/153 |
| 2016/0322181 | A1* | 11/2016 | Ho | H01H 19/20 |
| 2016/0329175 | A1* | 11/2016 | Bowen | H01H 19/14 |
| 2017/0182924 | A1* | 6/2017 | Lendo | B60L 53/16 |

* cited by examiner (Section A-A)

SWITCHING MECHANISM MOUNTABLE ON PRINTED CIRCUIT BOARD

FIELD OF INVENTION

The present invention relates to a switching mechanism for electrical switch assemblies and, in particular, to a switching mechanism mounted directly onto an electrical printed circuit board or switchboard for the manually selected routing of low voltage, high electrical current by mechanical means.

BACKGROUND OF THE INVENTION

There is a problem in electrical circuits in that, as electrical circuit current increases, so does the potential for electrical arcing when electrically loaded mechanical connections in relays and switches separate. Furthermore, where such connections or electrical contacts move slowly, arc damage can be severe, particularly as most known switching mechanisms on printed circuit boards involve horizontal sliding elements moving at hand operating speed. Conventional circuit board material is thin copper with, at best, a plated layer of silver or gold to minimise surface oxidation and improve electrical connection, and so any substantial erosion of the board material by arcing or surface heating will severely impact the performance of the switching function.

Most known multi-function switches utilise a single moving contact or contact pair sliding over or past multiple circuit board contact locations, and so any damage to the faces of such a moving contact set at one location can be transferred to other contact faces at other board locations thereby accelerating failure of the contact set.

Where reactive loads, such as large transformers or capacitators are being managed by such switches, the momentary high voltage or currents can substantially increase "make and break" arcing. This arcing, although it occurs for a very short duration, causes significant contact surface melting and damage to the primary connection faces which, when the contact faces have settled, increases contact voltage drop and generates increased contact heating when high current is present. Variable contact voltage drop causes variability of the heat generated at contact locations to the degree that the performance of plastic components in switches can be compromised, and so, where such plastic components are used to support pressure components, such as springs, this compromised performance will lead to the total failure of the switch in many cases.

Conventionally, to reduce voltage drop across contacts, higher contact pressure is used. For sliding contacts, this increased pressure also means increased drag which degrades switch operation "feel". This then requires increased pressure on the detent mechanism which results, over time, in an even higher amount of effort needed to operate the switch as switching current rating increases.

DISCLOSURE OF THE INVENTION

It is an object of the present invention to provide a switch assembly which utilises a switching mechanism capable of switching high currents with minimal heating, burning or other damaging effects, such as may be the result of electrical arcing.

It is another object to provide a switch assembly which provides improved tactile feedback to the user so that the user can be confident that the switching operation has been properly completed.

It is still another object to provide a switch assembly which utilises a switching mechanism that minimises "make and break" arcing by having specially arranged and separate arcing zones at the edges of primary contact zones of contact elements.

According to the present invention, there is provided a switching mechanism for an electrical switch assembly, comprising:

a rotary switch mounted on a printed circuit board, and comprising a contact block having a plurality of conductive contact faces arranged in the general shape of a polygon and adapted to roll from one contact face to another as the rotary switch is turned, a manually rotatable knob for turning the rotary switch, and mounted on a surface spaced apart from the printed circuit board, a rotatable shaft assembly operatively connecting the rotatable knob with the rotary switch so as to allow simultaneous and coordinated turning of the rotary switch when the knob is manually rotated, a plurality of conductive terminal contacts mounted on the printed circuit board and upon which the contact block rolls, each conductive terminal contact being for a separate current flow pathway, wherein rolling of the contact block on its contact faces selectively opens and closes a desired current flow pathway.

Preferably, the rotary switch further comprises a spring for applying a spring bias to the contact lock as it rolls on its contact faces.

It is preferred that the switching mechanism further comprises an indexing block mounted on the printed circuit board.

The indexing block preferably comprises a plurality of indexing teeth over which the contact block can move so as to cause a contact face of the contact block which was in contact with a conductive terminal contact to be lifted therefrom, thereby opening a circuit of which the conductive terminal contact was a part.

In a preferred form, the contact block further comprises separate arcing zones at the edges of the contact faces.

The arcing zones are preferably minor contact faces which are inclined at approximately 10° below the plane of the adjacent contact face of the contact block.

It is also preferred that the contact block further comprises a corner peak between a pair of adjacent contact faces, whereby the corner peak contacts an electrically isolated section of the printed circuit board which is located in a gap between adjacent conductive terminal contacts.

MODES FOR CARRYING OUT THE INVENTION

Figure 1:
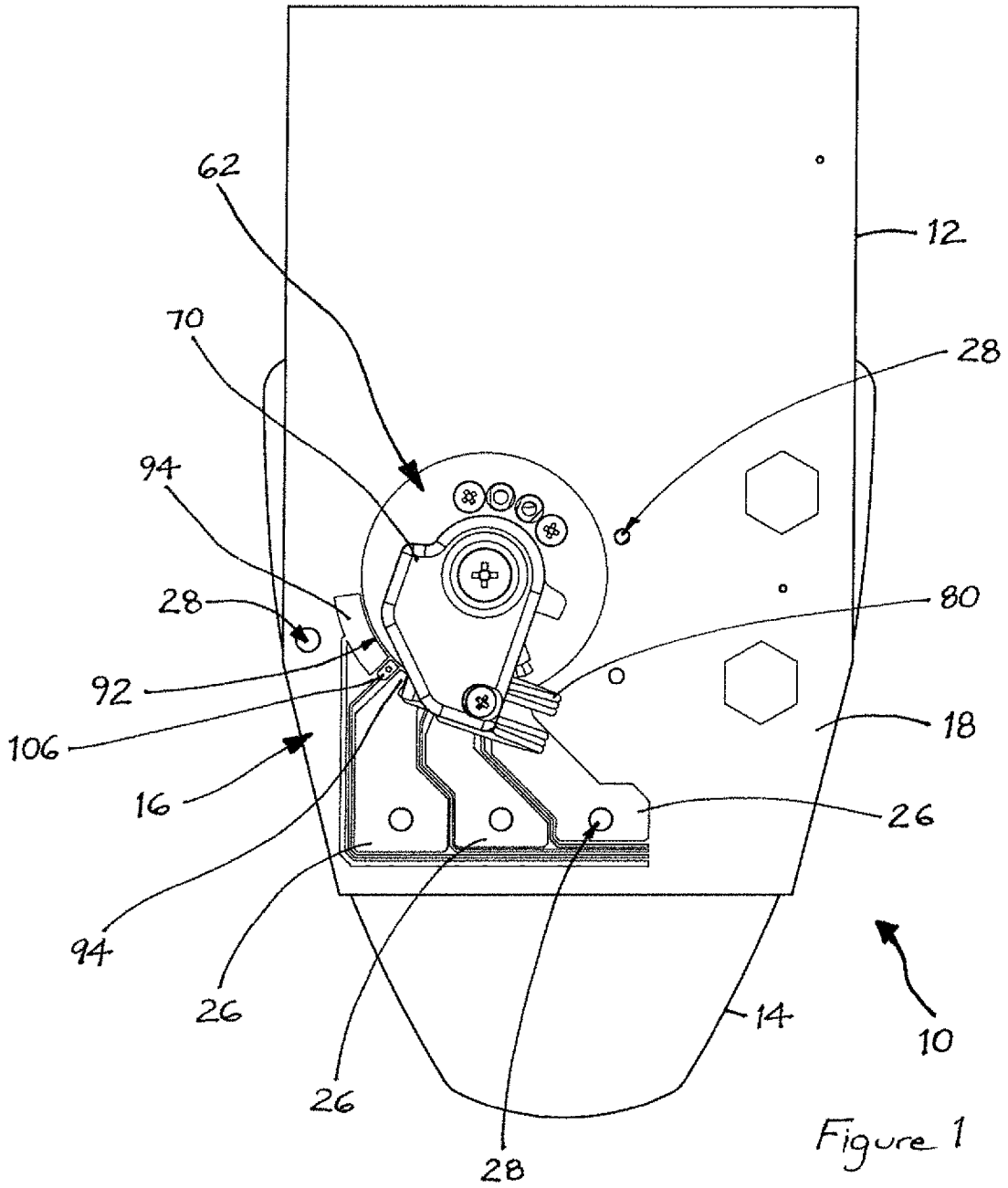
FIG. 1 is a top view of a switch assembly, as seen from the interior of a control device in which the switch assembly is housed, in accordance with an embodiment of the present invention.
Figure 2:
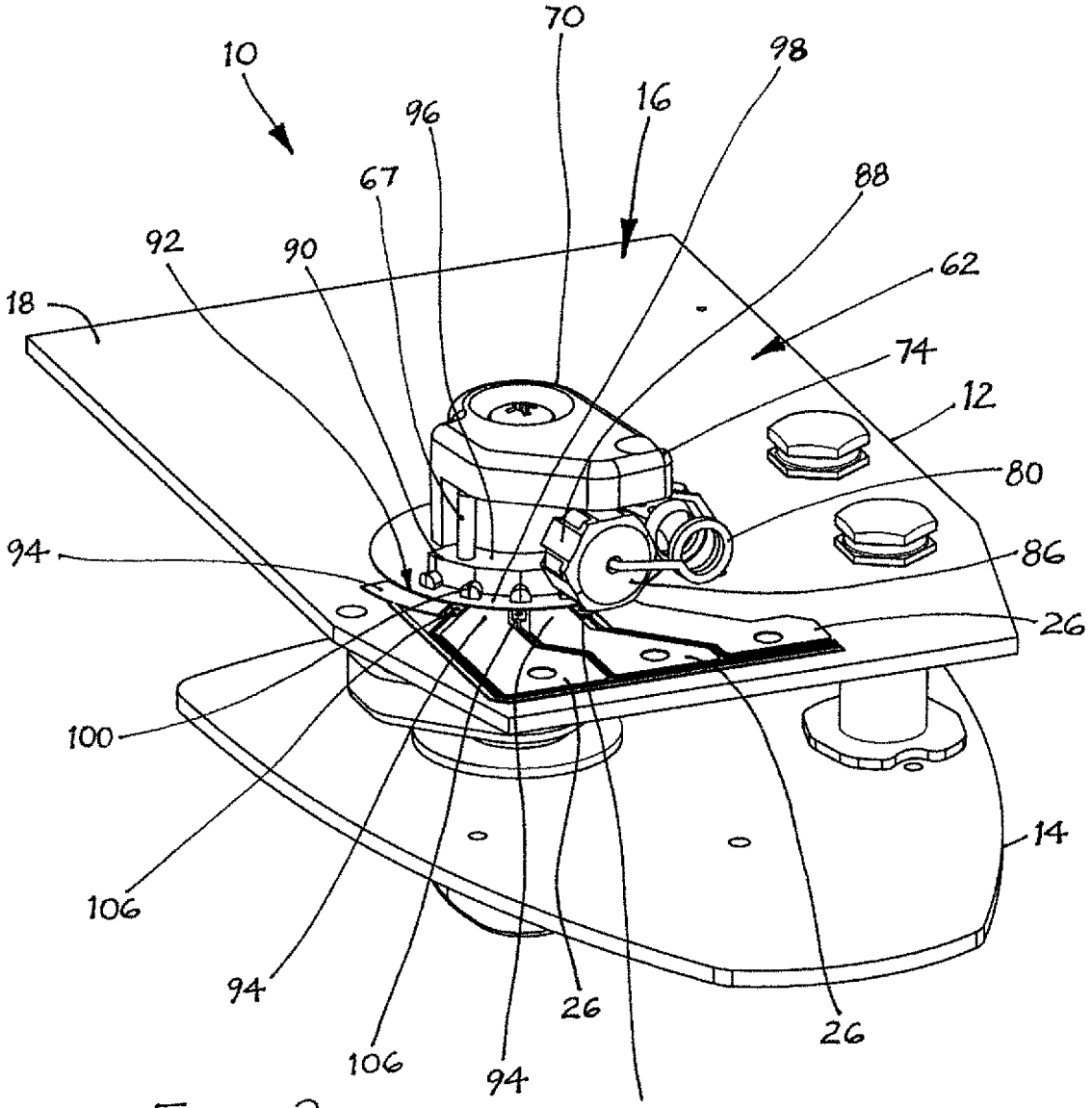
FIG. 2 is an upper perspective view of the switch assembly of FIG. 1.
Figure 3:
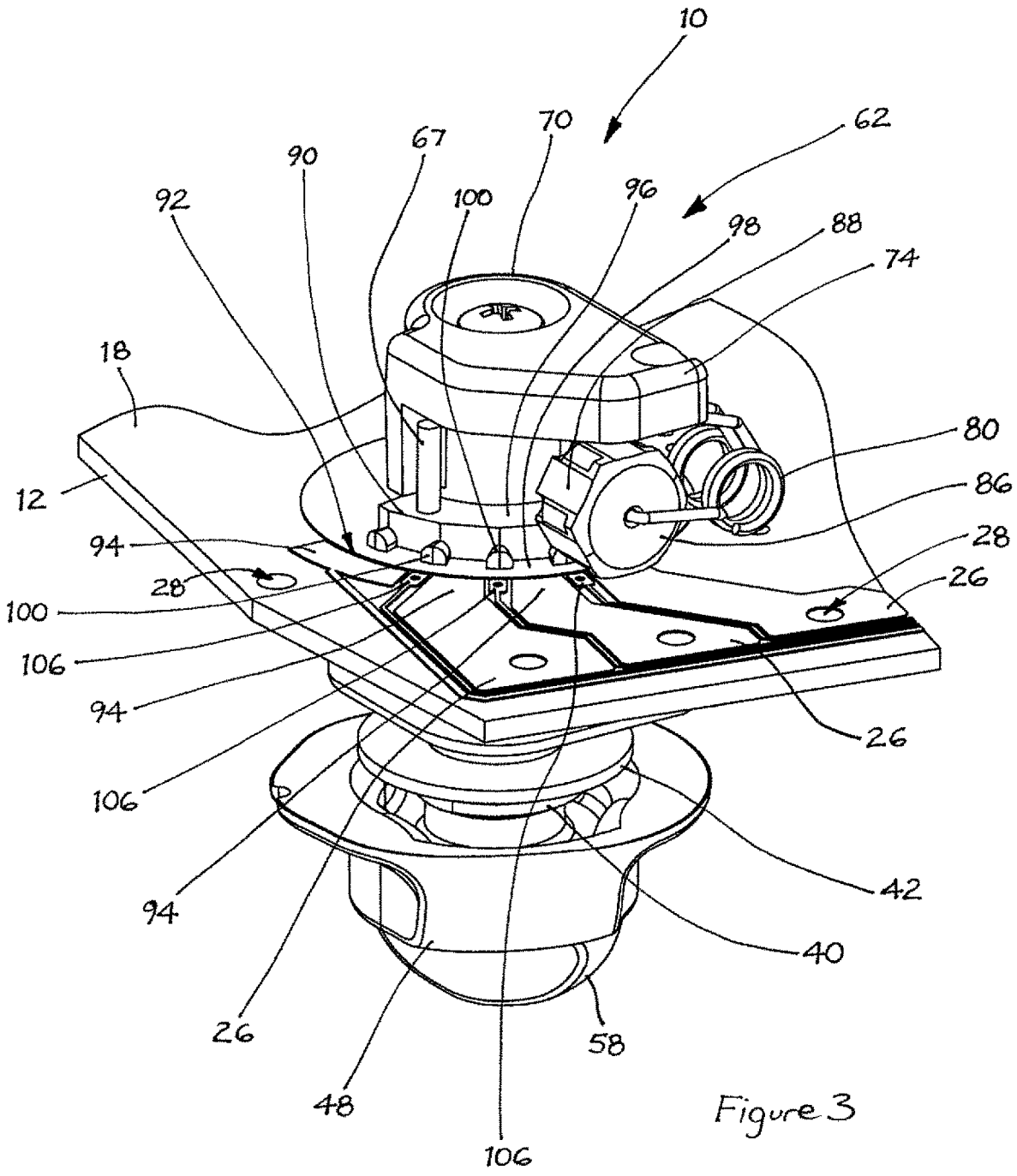
FIG. 3 is a partly broken-away, upper perspective view of the switch assembly as shown in FIG. 2 but with part of the electrical circuit board removed and all of the front panel removed to show greater detail.
Figure 4:
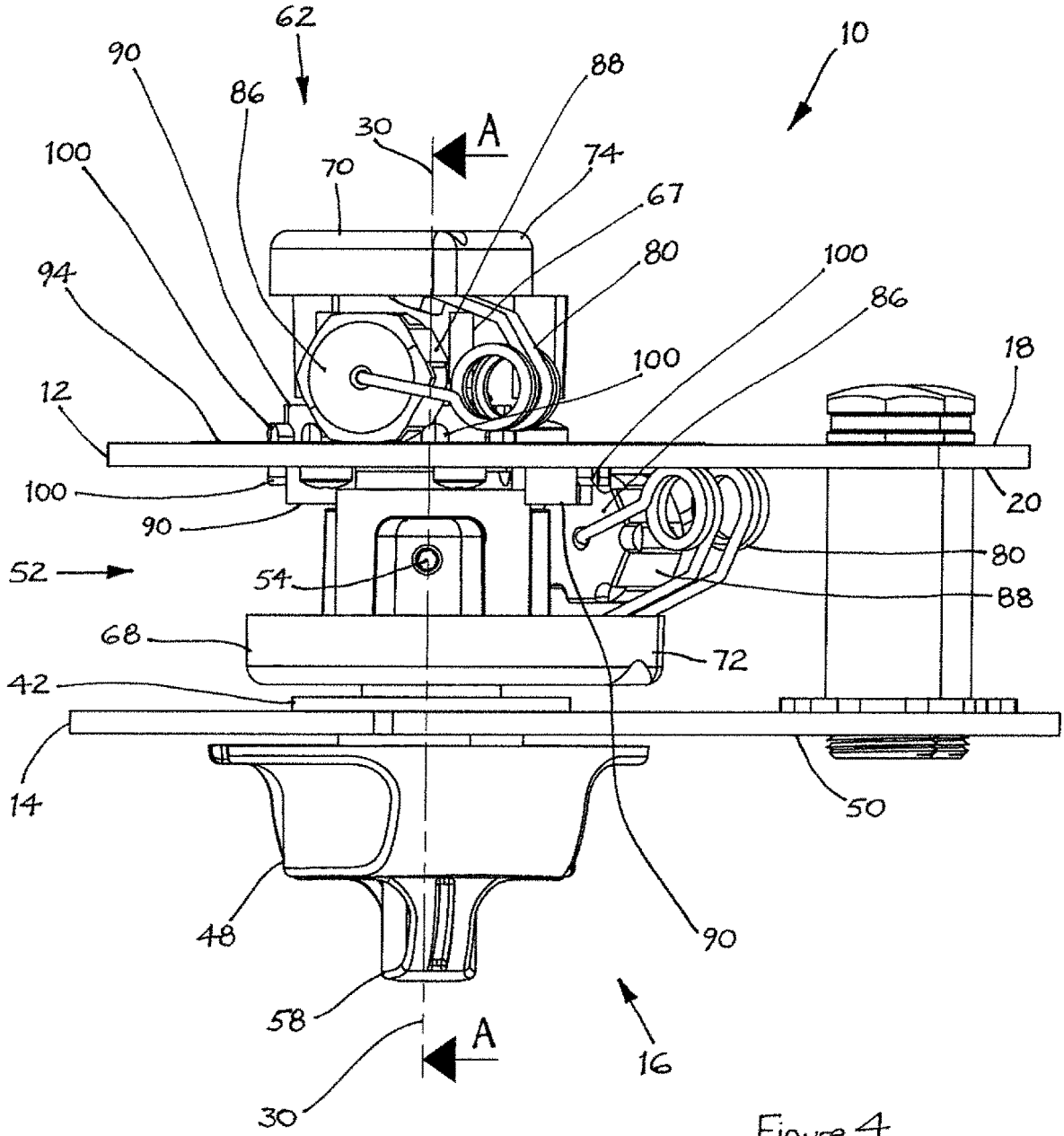
FIG. 4 is a front side elevation view of the switch assembly as shown in FIG. 2.

The embodiment of the switch assembly 10 shown in FIGS. 1 to 13 of the drawings can be utilised for operating an electrical apparatus, such as an electrical weld cleaning brush assembly or other apparatus that operate at low voltage but high current. The switch assembly 10 has a printed circuit board 12 or electrical switchboard which is spaced internally from an external or front panel 14 of a control device, and also has a switching mechanism 16 which operatively interconnects the printed circuit board 12 and the front panel 14.

The printed circuit board 12 is formed, in this embodiment, of a non-conductive flat panel of glass reinforced polyester material (or other insulating material) and is several millimetres thick. Onto one or both of the flat surfaces of the polyester panel is bonded (during manufacture of the printed circuit board) a copper layer (or other conducting material) of a thickness appropriate for the electrical current intended for operating the apparatus. In the embodiment shown in the drawings, both the internally and externally facing surfaces 18, 20 of the printed circuit board have a copper layer bonded thereon.

In a subsequent manufacturing step, current flow pathways 26 in the or each copper layer are created by a process of chemically etching fully through the thickness of the copper layer in a manner that defines separated copper conductive sections that, when activated by a voltage source causing an electrical current to flow, can channel the electricity from one location on the printed circuit board to another.

The printed circuit board 12 has a variety of holes 28 drilled fully therethrough for various purposes, such as for structural or mounting purposes, or for the channeling of electricity.

Figure 5:
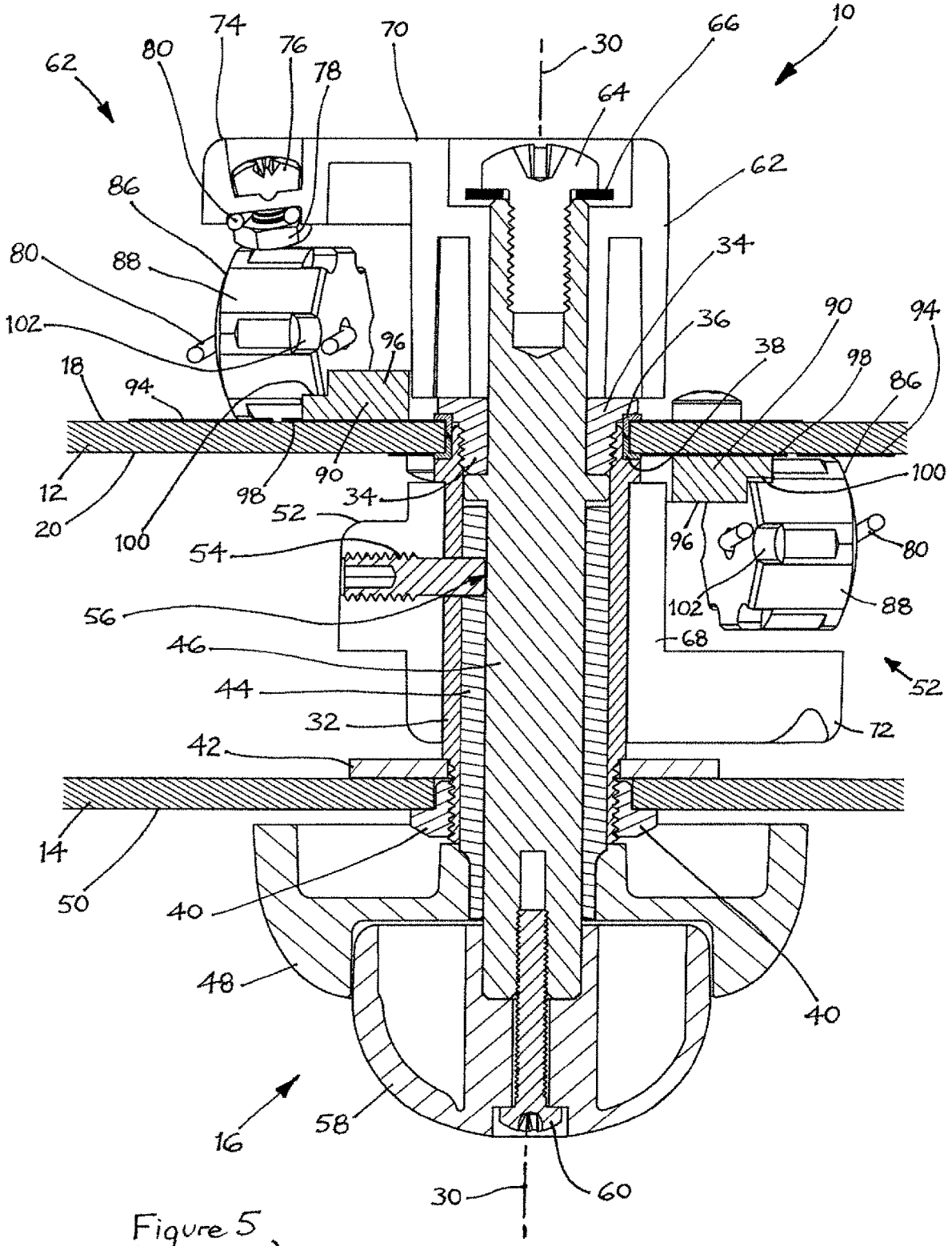
FIG. 5 is a cross-sectional view through A-A of the switch assembly as shown in FIG. 4.

The switching mechanism 16 is rotatably mounted to both the front panel 14 and the printed circuit board 12, through respective holes (as best shown in FIG. 5) formed in the front panel and printed circuit board, which holes define a central rotational axis 30 for the switching mechanism 16.

A cylindrical bearing sleeve 32 of the switching mechanism 16 is screwably and tightly retained at a first end thereof by a nut 34 which, together with a pair of adjoining, but separately movable, insulator bushes 36, 38, sandwich and rigidly engage to the printed circuit board 12. The bearing sleeve 32 is also screwably and tightly retained at a second end thereof by a nut 40, which, together with a washer 42, sandwich and rigidly engage to the front panel 14.

Located axially within and adjacent to the bearing sleeve 32 is a rotatable mode shaft 44, and located axially within and adjacent to the mode shaft is a rotatable power shaft 46.

The mode shaft 44 facilitates the manual turning by a user of a mode knob 48 which is located at the external side 50 of the front panel 14 to cause the simultaneous and coordinated turning of a mode rotary switch 52 acting on the externally facing surface 20 of the printed circuit board 12. The mode rotary switch 52 is secured rigidly to, and co-axially with, the mode shaft 44 by a grub screw 54 inserted laterally into the mode rotary switch, and the bearing sleeve 32 (which is stationary and sandwiched between the mode rotary switch 52 and the mode shaft 44) has an elongated track 56 through and along which the grub screw can travel during turning of the mode knob 48.

The power shaft 46 facilitates the manual turning by a user of a power knob 58, to which it is secured rigidly by an axially aligned screw 60, the power knob being located at the external side 50 of the front panel 14, but outwardly from, and co-axially with, the mode knob 48 to cause the simultaneous and coordinated turning of a power rotary switch 62 acting on the internally facing surface 18 of the printed circuit board 12. The power rotary switch 62 is secured rigidly to, and co-axially with, the power shaft 46 by a screw 64 and washer 66.

The mode knob 48 and the power knob 58 can each be turned in both clockwise and anticlockwise directions independently of each other. The extent of turning of the mode knob 48, and hence that of the mode rotary switch 52, is limited by the extent of the elongated track 56, and the extent of turning of the power knob 58, and hence that of the power rotary switch 62, is limited by a pair of spaced apart posts 67 which impede the further turning of that switch.

A purpose of each of the rotary switches 52, 62 is, by manual turning of its respective knob 48, 58, to reliably select a specific current flow pathway 26 among a plurality of current flow pathways which are available on the printed circuit board 12, for the channeling of electricity from a voltage source to power an electrical apparatus or any other external circuit voltage drain or load.

Each rotary switch 52, 62 has an insulating support body 68, 70, from which protrudes, in the embodiment shown in the drawings, a single support arm 72, 74. In alternative embodiments, the insulating support body of one or both of the rotary switches may have a pair of spaced apart support arms.

Secured by a screw 76 and nut 78 at an end of the support arm 72, 74 remote of the axis 30 is one end of a twin leg torsion spring or coiled spring 80. The other end of the coiled spring 80 provides a pair of spaced apart spring arms 82 that face each other and are each inserted into respective opposite openings of a central hole 84 formed through a generally hexagonal shaped contact block 86 which is made of a conducting material. This provides a rotating axis for the contact block 86, the rotation of which is a result of turning the knob 48, 58 and the operation of an indexing arrangement between the contact block 86 and an indexing block 90 (to be described in more detail later in the specification) which causes the contact block to roll over, not slide along, the printed circuit board 12. In alternative embodiments, the contact block may have a different polygonal shape that is suitable for its purpose.

The contact block 86 is adapted to selectively and conductively bridge an otherwise insulated gap 92 on the printed circuit board 12 between the indexing block 90, which may be formed of exposed copper and is electrically connected to, and receives current from, a voltage source, and one of a plurality of exposed copper conductive terminal contacts 94 for a selected current flow pathway 26 which is separated or insulated from adjacent exposed conductive terminal contacts 94 for other current flow pathways 26.

In operation, the coiled spring 80 creates a bias which favours the stable location and contact of a selected contact face 88 of the contact block 86 (from among a larger number of contact faces of the contact block that can be selected) on the selected conductive terminal contact 94.

Once that stable location and contact has been made, current flows from a voltage source through a conductive path to the indexing block 90 and then across the contact block 86 to the selected conductive terminal contact 94, and ultimately to power an electrical apparatus or any other external circuit voltage drain or load.

The earlier mentioned indexing arrangement between the contact block 86 and the indexing block 90, and which allows the contact block to roll over successive conductive terminal contacts 94 on the printed circuit board 12, will now be described in more detail.

The indexing block 90 has an upwardly stepped block portion 96 and a floor portion 98, and a plurality of spaced apart indexing teeth 100 that protrude from the side of the block portion and contact the floor portion at locations which effectively correspond to gaps between each adjacent pair of conductive terminal contacts 94. Each indexing tooth 100 is adapted to engage a respective one of a plurality of female indexing grooves 102 formed at the junction of adjoining contact faces 88 at the rear of the contact block 86 and as the contact block is rolled over any indexing tooth between successive conductive terminal contacts 94. The indexing teeth 100 provide a resistance to any sideways motion of the contact block 86 on the printed circuit board 12 so that, instead of the contact block sliding along the printed circuit board upon only one of its faces 88 and not having any means to stably and selectively locate and contact its faces on a selected conductive terminal contact 94, the contact block 86 rolls upon the printed circuit board 12 from one of its faces 88 to another so as to stably locate and contact a selected contact face of the contact block on a selected conductive terminal contact.

During this rolling action, each indexing tooth 100 lifts the contact block 86 clear of the conductive terminal contact 94 it had previously been contacting, thereby breaking the electrical circuit.

Figure 6:
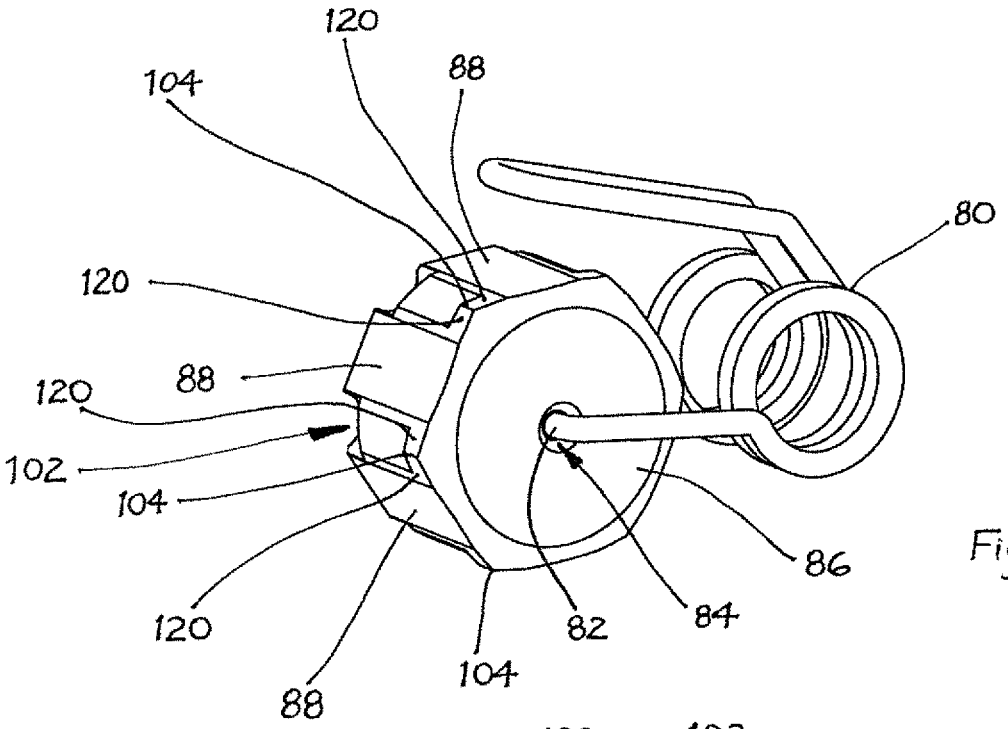
FIG. 6 is a perspective view of a coiled spring and contact block assembly utilised in the switching mechanism of the switch assembly as shown in FIGS. 1 to 5.
Figure 7:
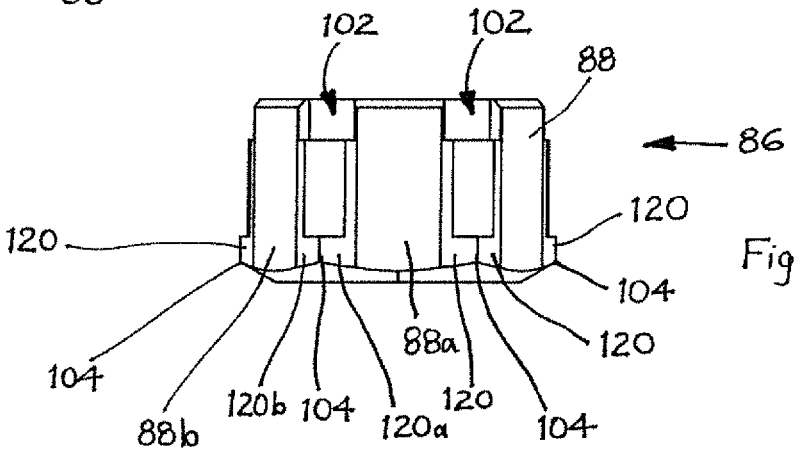
FIG. 7 is a top view of a contact block utilised in the switching mechanism of the switch assembly as shown in FIGS. 1 to 5.
Figure 8:
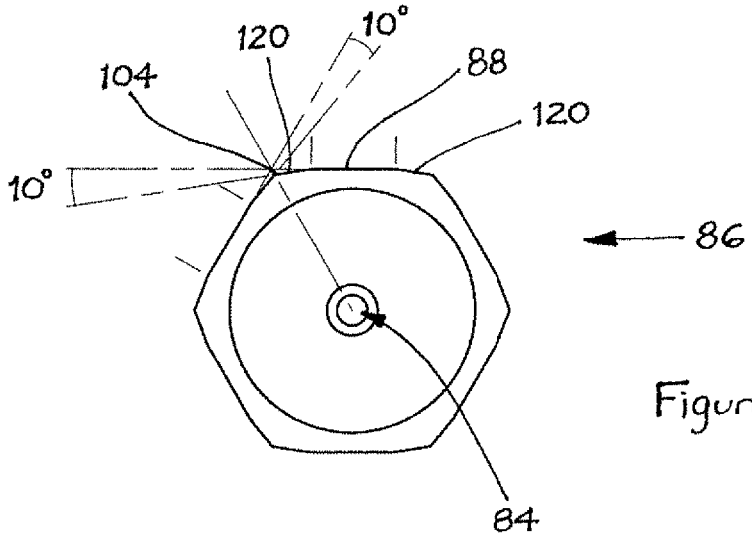
FIG. 8 is a front side elevation view of the contact block as shown in FIG. 7.

The lifting of the contact block 86, and its rolling over to make contact with an adjacent conductive terminal contact 94, is further assisted by the contact block having corner peaks 104, which are small protrusions located near the front of the contact block 86 and where one contact face 88 meets another contact face of the contact block (see especially FIGS. 6 to 8). Each corner peak 104 serves to pivot the contact block 86 against the printed circuit board 12 as the contact block is being lifted by, and rolled over, an indexing tooth 100. Each corner peak 104 contacts an electrically isolated or insulated section 106 of the printed circuit board 12 which is located in a gap between adjacent conductive terminal contacts 94.

The indexing arrangement described in detail above facilitates the rolling of the contact block 86 from one stable detent location, in which one contact face 88 is contacted on a conductive terminal contact 94, to the next stable detent location, in which an adjacent contact face 88 of the contact block 86 is stably and selectively located and contacted on a selected adjacent conductive terminal contact 94. This closes a circuit to allow current to flow along a selected current flow pathway 26 for channeling of electricity from a voltage source to power, say, an electrical weld cleaning brush assembly.

A well known problem associated with the switching of high current circuits is the occurrence of electrical arcing between electrical connections when opening (breaking) and closing (making) an electrical circuit. The arc intensity is proportional to the amount of current in the circuit, and a high arc intensity causes extreme heating of the surfaces from which the arc emanates. Such heating instantaneously damages the arcing surfaces to the extent that an electrical connection from such damaged surfaces becomes unreliable and otherwise problematic.

The problem of electrical arcing has been addressed and managed in the present invention by the switch assembly 10, and the switching mechanism 16 of that assembly, utilising an arrangement which causes the electrical arcing, and the damage to the electrical contacts caused by an arc connection therebetween, to occur at locations separate to the stable and selective locations as mentioned earlier. In this embodiment, the contact block 86, which is generally hexagonal in shape and has a maximum of six primary contact faces 88 (or $n \leq 6$) that may be utilised to close an electrical circuit, has been formed with the earlier described corner peaks 104 so that it also has twelve minor contact faces 120 (or 2n), wherein an adjacent pair of minor contact faces constitute a single corner peak. Each of the minor contact faces 120 is inclined approximately 10° downwardly from the adjacent primary contact face 88 (see especially FIG. 8). Each minor contact face 120 is approximately a quarter of the width of its adjacent primary contact face 88.

Figure 9:
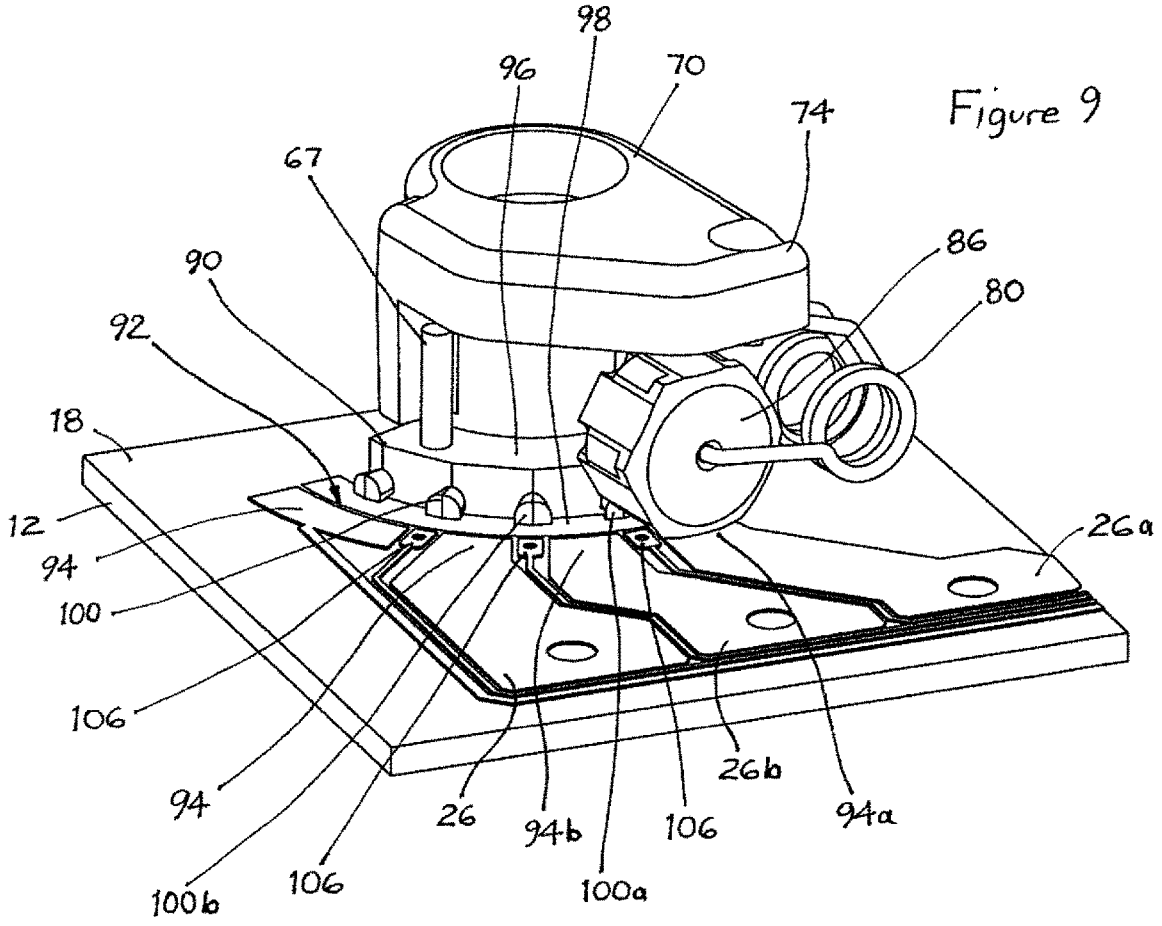
FIG. 9 is an upper perspective view of a portion of the switch assembly as shown in FIGS. 1 to 5 showing a portion of the electrical circuit board and a portion of the switching mechanism which is mounted operatively thereon, with the contact block shown in a stable detent location upon a first terminal contact.
Figure 10:
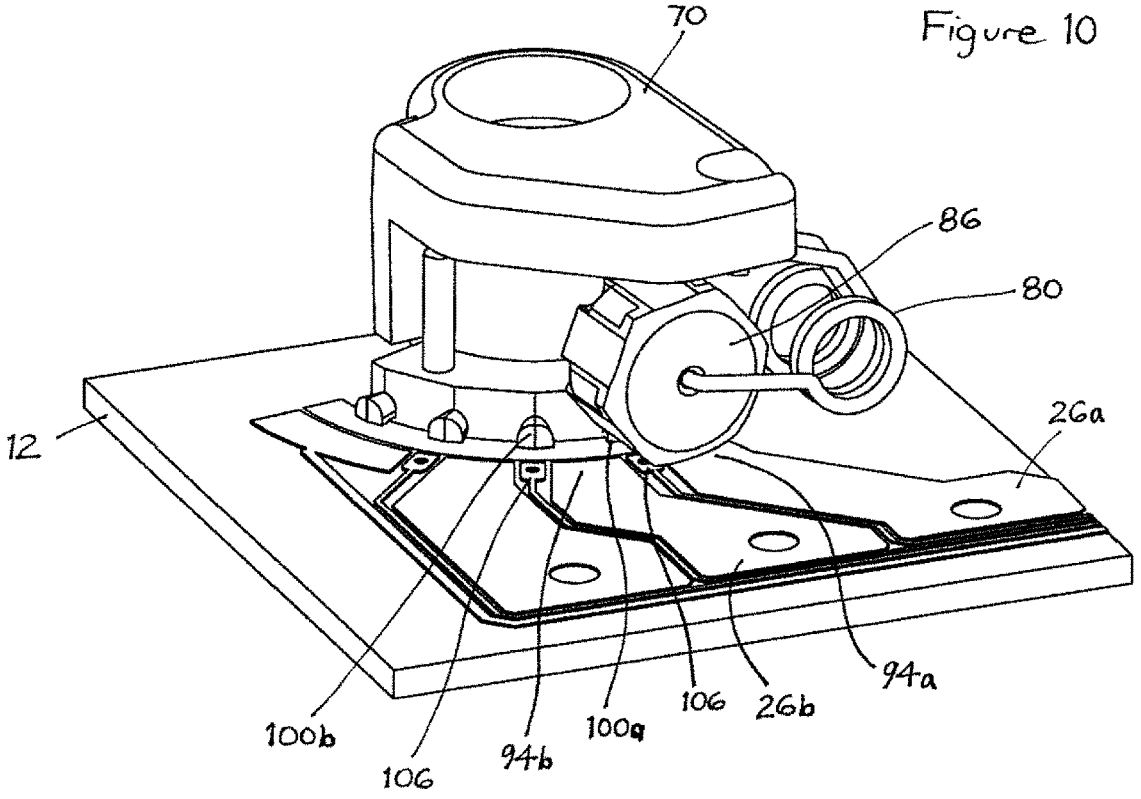
FIG. 10 is a view similar to that of FIG. 9, but with the contact block shown in a partial contact position with the first terminal contact after the contact block has rolled approximately 10°.

In operation, and as shown in FIGS. 9 to 13, when the contact block 86 commences the process of rolling from one stable detent location, in which it closes a first circuit **26*a* by having its first primary contact face 88*a* (see FIG. 7 for such contact faces) fully contact a first terminal contact 94*a* as shown in FIG. 9, to another such location, the contact block 86 first rolls approximately 10° onto its adjacent minor contact face 120*a* through which it remains in partial contact with the first terminal contact 94*a* as shown in FIG. 10. In this position, electrical connection to the first circuit is maintained and the same level of current is carried as before. This new partial contact of the contact block 86 with the first terminal contact 94*a* through the minor contact face 120*a* of the contact block means that the point of contact has moved to a trailing (or left side) edge of the first terminal contact 94*a*** and away from the stable and more central contact of the detent location.

Figure 11:
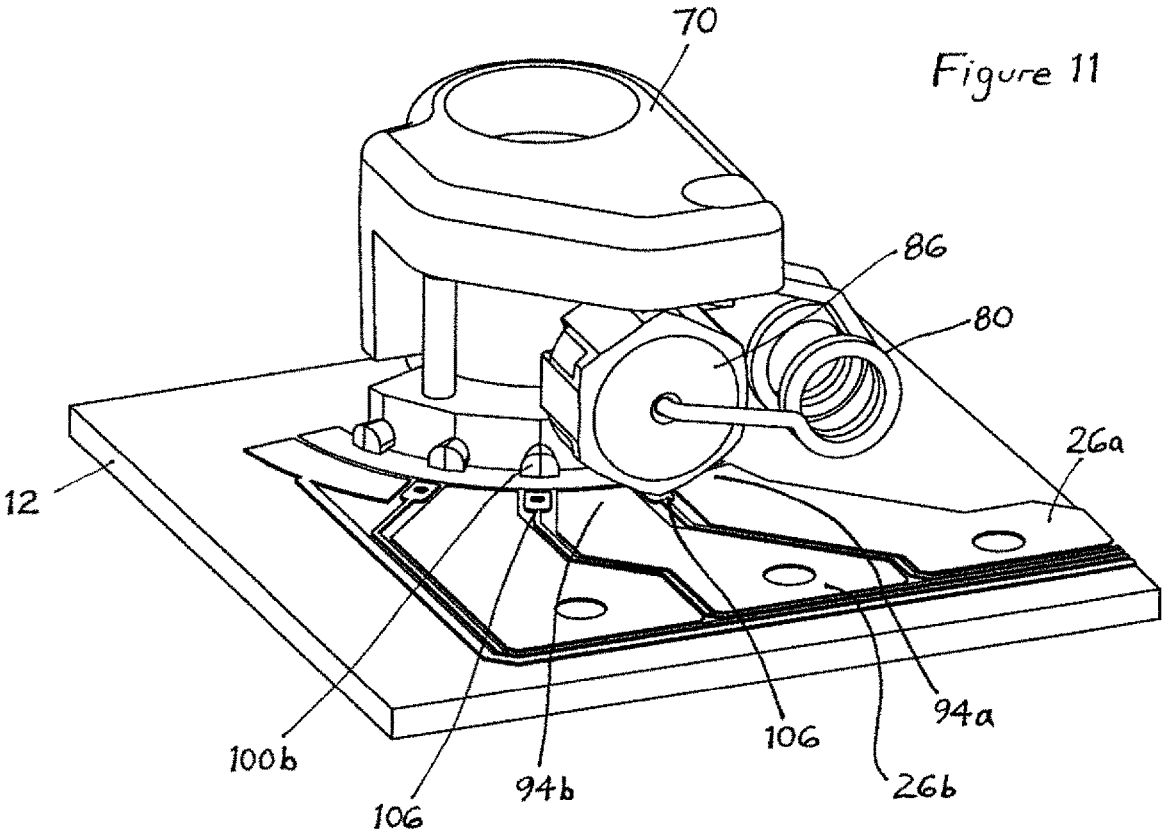
FIG. 11 is a view similar to that of FIG. 10, but with the contact block shown after having further rolled to a position where it is both lifted by an indexing block and pivoting on a corner peak of the contact block against an electrically isolated section of the circuit board between the first and a second terminal contact.

As the rolling process continues, the minor contact face **120*a* lifts clear of the first terminal contact 94*a* as shown in FIG. 11**, and electrical arcing may occur briefly until the arcing surfaces are far enough away from each other for the arc connection to be broken.

Figure 12:
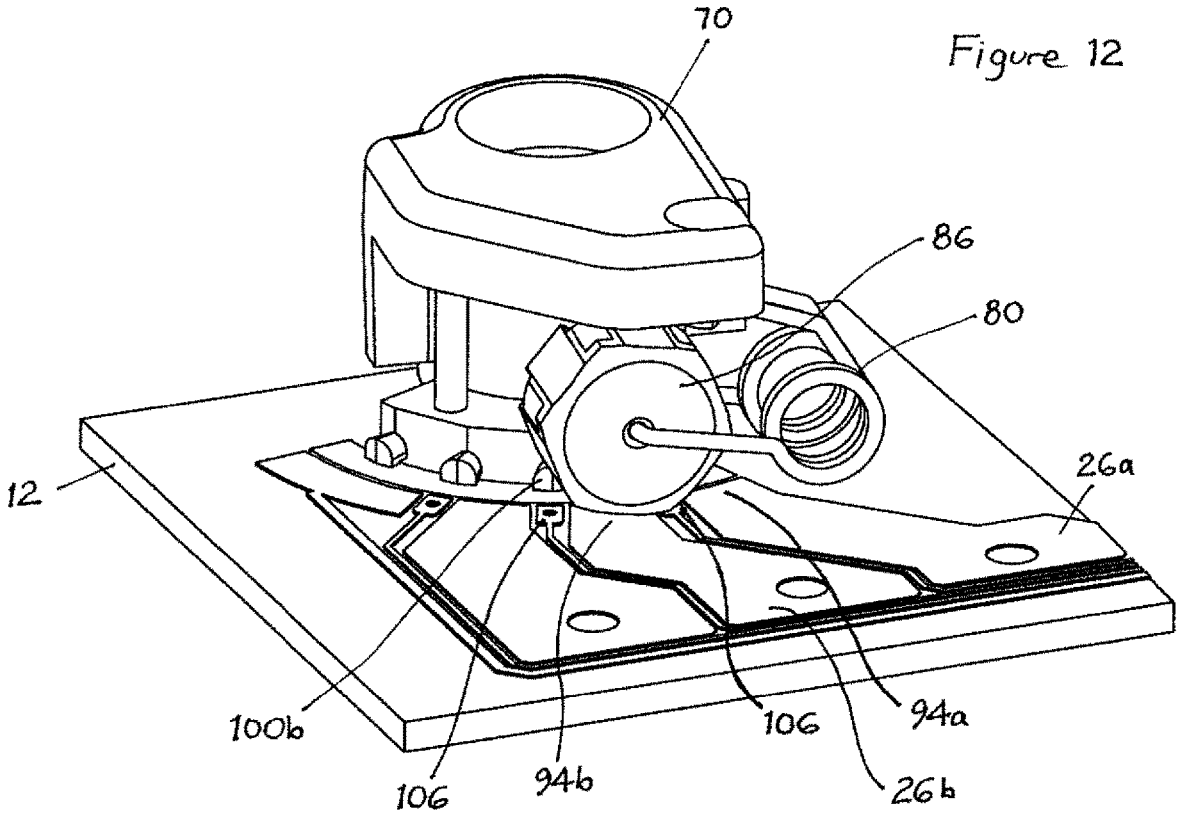
FIG. 12 is a view similar to that of FIG. 11, but with the contact block shown in a partial contact position with the second terminal contact after the contact block has further rolled another approximately 10°.
Figure 13:
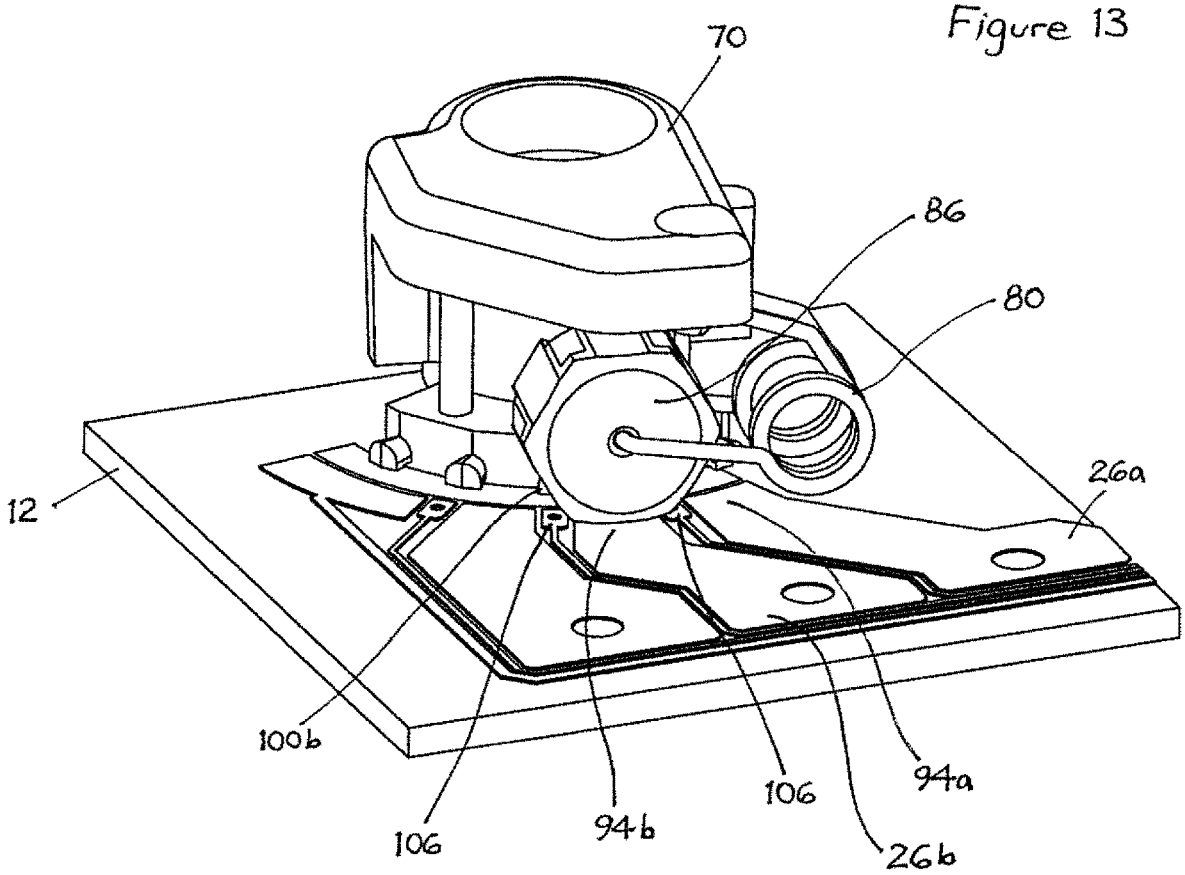
FIG. 13 is a view similar to that of FIG. 12, but with the contact block shown after having further rolled to a stable detent location upon the second terminal contact.

Continued rolling causes the next electrical connection to be made between the next (and adjacent) minor contact face 120*b* of the contact block 86 and a leading (or right side) edge of the next terminal contact 94*b* as shown in FIG. 12. Arcing may occur between the minor contact face 120*b* and the leading edge of the terminal contact 94*b* as they move closer together, until the next primary contact face 88*b* of the contact block 86 reaches a stable detent location in which it closes another circuit 26*b* and quenches any arc by making full contact with the terminal contact 94*b* as shown in FIG. 13.

As a new electrical circuit 26*b* has been made, no further arcing will occur, and any arcing that has occurred during this operation has been minor and very little or no damage to electrical contact surfaces has resulted from such arcing.

It will be readily apparent to persons skilled in the art that various modifications may be made in the details of the structure and function of the invention described above without departing from the scope of the invention.

The invention claimed is:

1. A switching mechanism for an electrical switch assembly, comprising:

a rotary switch mounted on a printed circuit board, and comprising a contact block having a plurality of conductive contact faces arranged in the general shape of a polygon and adapted to roll from one contact face to another as the rotary switch is turned, a manually rotatable knob for turning the rotary switch, and mounted on a surface spaced apart from the printed circuit board, a rotatable shaft assembly operatively connecting the rotatable knob with the rotary switch so as to allow simultaneous and coordinated turning of the rotary switch when the knob is manually rotated, a plurality of conductive terminal contacts mounted on the printed circuit board and upon which the contact block rolls, each conductive terminal contact being part of a circuit for a separate current flow pathway, wherein rolling of the contact block on its contact faces selectively opens a circuit and closes an adjacent circuit to allow electricity to flow along a desired current flow pathway.

2. The switching mechanism of claim 1, wherein the rotary switch further comprises a spring for applying a spring bias to the contact lock as it rolls on its contact faces.

3. The switching mechanism of claim 1, further comprising an indexing block mounted on the printed circuit board.

4. The switching mechanism of claim 3, wherein the indexing block comprises a plurality of indexing teeth over which the contact block can move so as to cause a contact face of the contact block which was in contact with a conductive terminal contact to be lifted therefrom, thereby opening a circuit of which the conductive terminal contact was a part.

5. The switching mechanism of claim 1, wherein the contact block further comprises separate arcing zones at the edges of the contact faces.

6. The switching mechanism of claim 5, wherein the arcing zones are minor contact faces which are inclined at approximately 10° below the plane of the adjacent contact face of the contact block.

7. The switching mechanism of claim 5, wherein the contact block further comprises a corner peak between a pair of adjacent contact faces, whereby the corner peak contacts an electrically isolated section of the printed circuit board which is located in a gap between adjacent conductive terminal contacts.

* * * * *